United States Patent [19]

Lindauer

[11] 4,163,424

[45] Aug. 7, 1979

[54] HOPPER DOOR LOCKING AND ACTUATING MECHANISM

[75] Inventor: Thomas Lindauer, Schererville, Ind.

[73] Assignee: Pullman Inc., Chicago, Ill.

[21] Appl. No.: 830,939

[22] Filed: Sep. 6, 1977

[51] Int. Cl.[2] ..... B61D 7/02; B61D 7/18; B61D 7/26; B61D 49/00

[52] U.S. Cl. ..... 105/313; 105/290; 105/296; 105/304; 105/310

[58] Field of Search ..... 105/250, 251, 253, 255, 105/290, 308 R, 308 B, 308 P, 310, 313, 296, 304; 114/230

[56] References Cited

U.S. PATENT DOCUMENTS

| | | | |
|---|---|---|---|
| 1,041,864 | 10/1912 | Ostrander | 105/310 |
| 1,065,218 | 6/1913 | Clark | 105/290 |
| 2,080,845 | 5/1937 | Yost | 105/253 |
| 3,109,389 | 11/1963 | Karlsson | 105/253 |
| 3,187,685 | 6/1965 | Floehr | 105/253 |
| 3,440,671 | 4/1969 | Smulders | 114/230 X |
| 3,440,761 | 4/1969 | Floehr | 105/290 |
| 3,656,437 | 4/1972 | Kuzmicki | 105/255 X |

*Primary Examiner*—Albert J. Makay
*Assistant Examiner*—Howard Beltran
*Attorney, Agent, or Firm*—Richard J. Myers

[57] ABSTRACT

Both an operating link and a locking hook member are secured on a shaft rotatably mounted on a hopper door. The hook member cooperates with a locking lug fixed relative to the hopper for securing the door closed. The operating link is both pivoted and pushed or pulled by a crank actuated by retainable handles for operating the hook member and opening and closing the door.

17 Claims, 7 Drawing Figures

HOPPER DOOR LOCKING AND ACTUATING MECHANISM

BACKGROUND OF THE INVENTION

1. Field of the Invention

The invention relates to mechanisms for both locking and swinging doors open and closed such as doors in the bottom openings of railway hopper cars.

2. Description of the Prior Art

U.S. Pat. Nos. 2,080,845 and 3,440,761 both illustrate typical railway hopper discharge door operating mechanism employing multiple linkage arrangements. Similarly, U.S. Pat. No. 1,065,218 shows a gear-driven arrangement for operating hopper doors.

The present invention contemplates an improvement over this art by providing a relatively simple hopper door operating mechanisms which provides smooth operation as well as positive locking of the hopper doors in the closed position.

SUMMARY OF THE INVENTION

The invention is summarized in a closing and locking arrangement for a pivoted hopper door including a shaft, bearing means rotatably mounting the shaft on the door spaced from the door pivot, an elongated hook member having one end secured to the shaft and having a hook formed in the other end of the hook member, a locking lug fixed relative to the hopper for cooperating with the hook on the hook member to secure the door closed, and operating link having one end secured to the shaft, crank means including an arm eccentrically pivoted to the other end of the operating link for pivoting the link to release and engage the hook with the locking lug and for pivoting the door open and closed.

An object of the invention is to construct a simplified but reliable closing and locking arrangement for a pivoted hopper door which is operated by a single mechanism.

Another object of the invention is to lock two transverse doors on a hopper car with the same motion as they are closed.

It is also an object of the invention to utilize pivotal movement of a door operating link when the door is closed to open and close a locking member.

One advantage of the invention is that the eccentric motion of a crank arm is utilized to produce sequential pivotal and longitudinal motion of an operating link to produce both (1) releasing or locking movement of a locking member, and (2) opening or closing movement of the door.

Other objects, advantages and features of the invention will become apparent from the following description of the preferred embodiment taken in conjunction with the accompanying drawings.

DESCRIPTION OF THE PREFERRED EMBODIMENT

Figure 1:
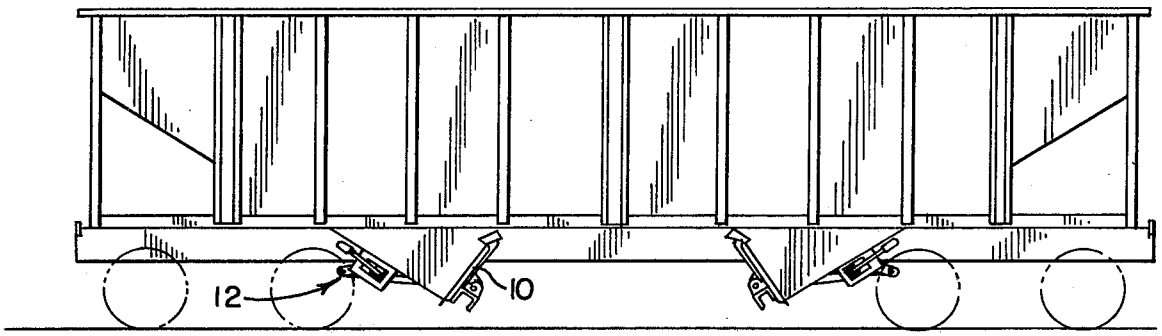
FIG. 1 is a side elevational view of a railway hopper car in accordance with the invention.

As illustrated in FIG. 1, the invention is embodied in a railway hopper car having a door 10 and a door locking and closing mechanism indicated generally at 12 for opening and closing a discharge opening in the bottom of the hopper car. A typical railway hopper car has pairs of transversely disposed openings and doors 10, two or more of the pairs spaced longitudinally along the bottom of the car. Hopper cars are generally used to carry bulk materials which can be discharged from the openings in the bottom of the hopper car when the doors 10 are open.

Figure 2:
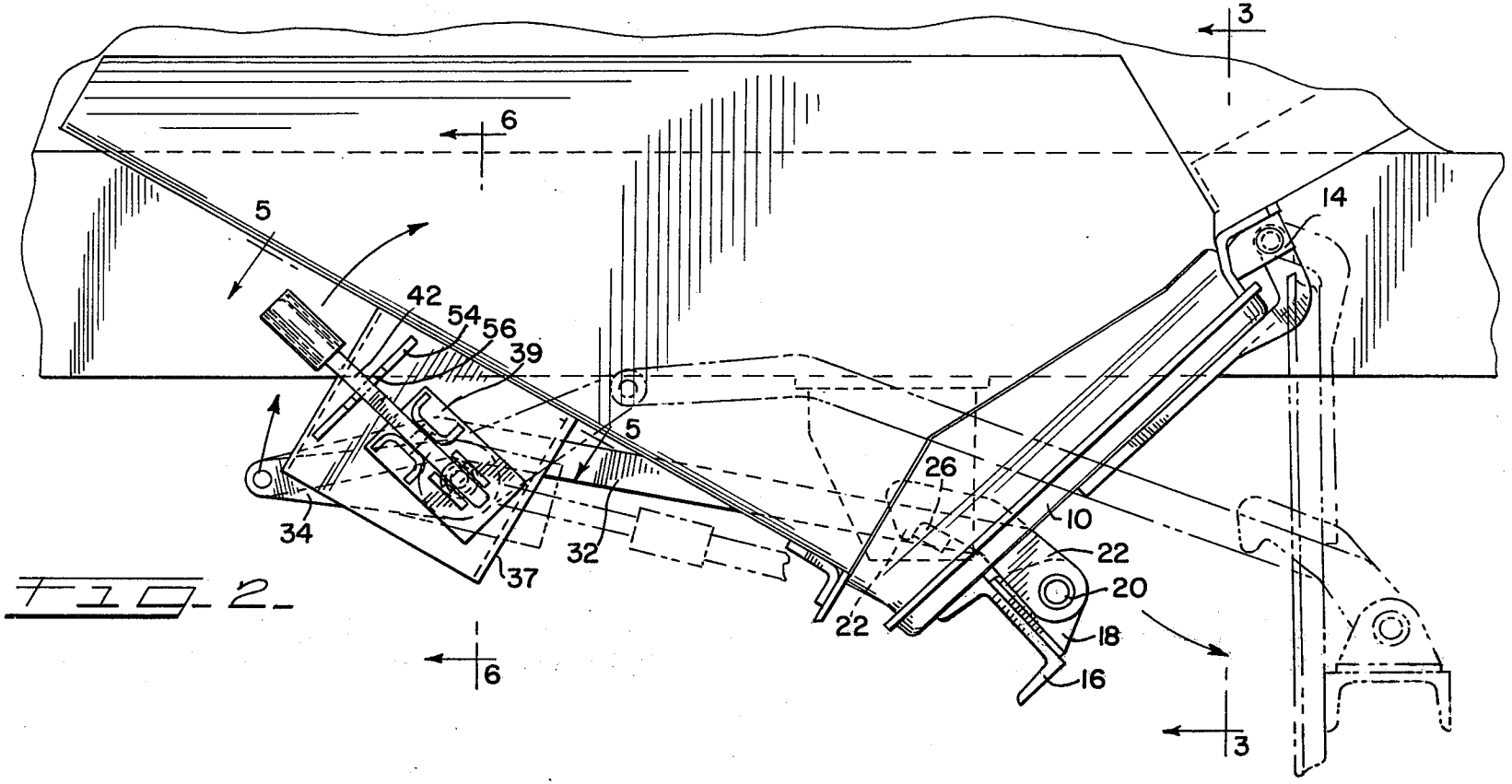
FIG. 2 is an enlarged detail view of a hopper closing and locking mechanism of the car of FIG. 1.
Figure 3:
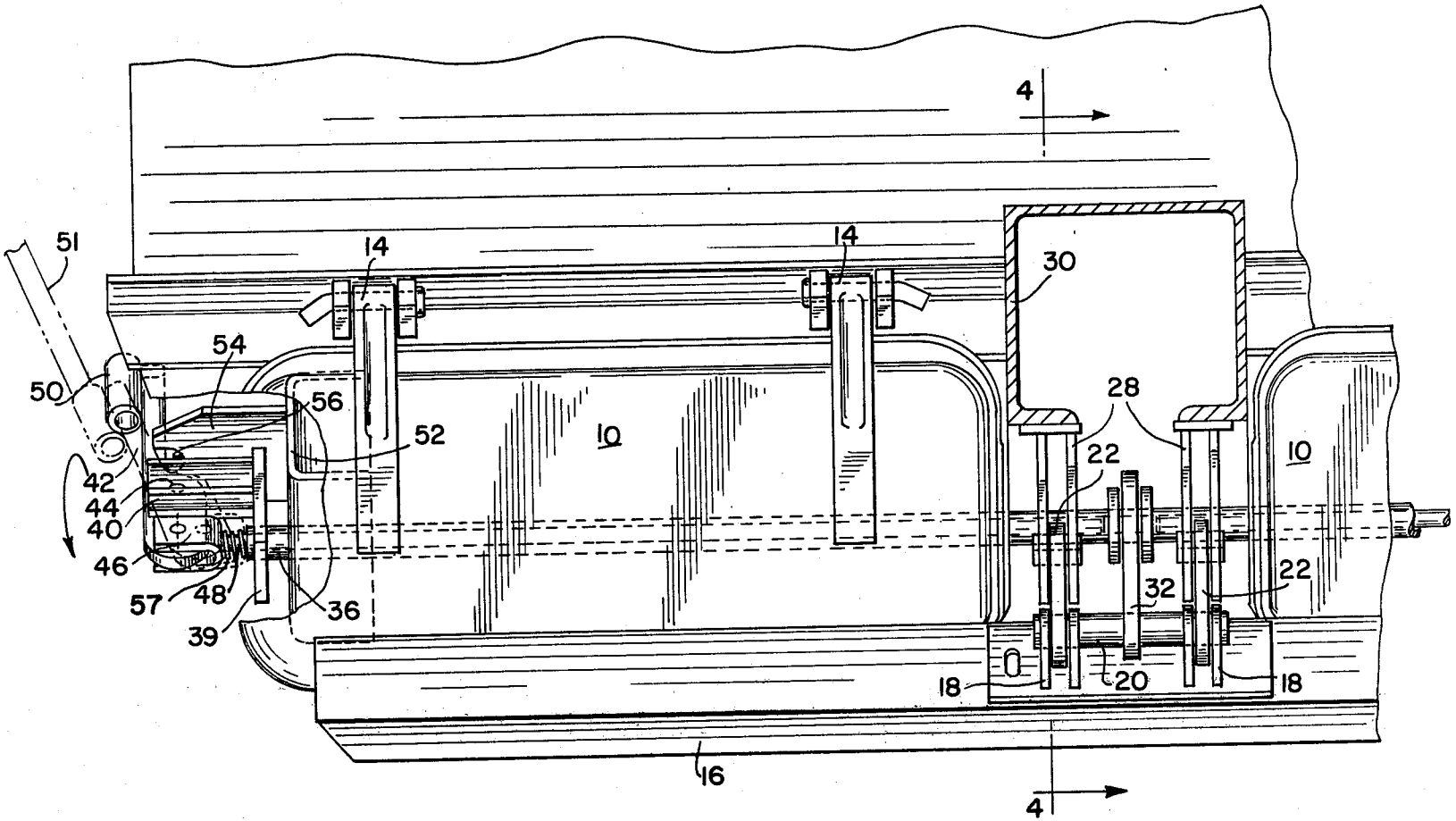
FIG. 3 is a cross-sectional view taken along line 3—3 of FIG. 2.
Figure 5:
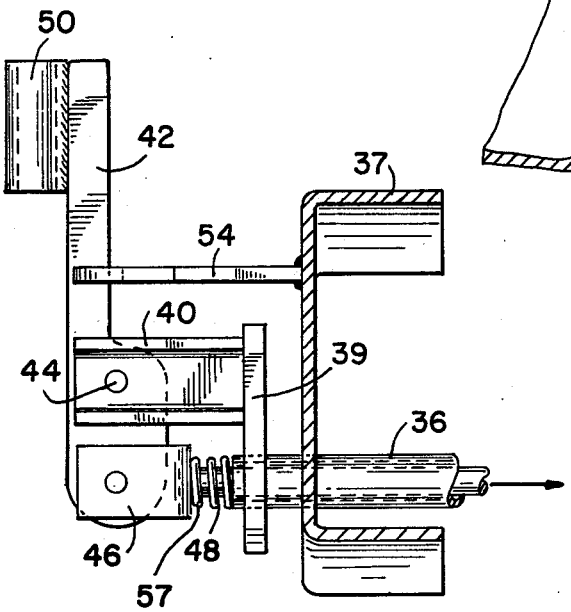
FIG. 5 is a cross-sectional view taken along line 5—5 of FIG. 2.
Figure 6:
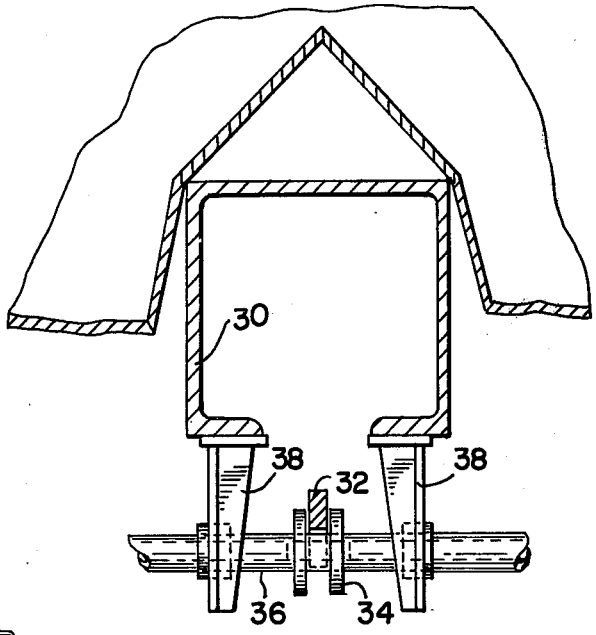
FIG. 6 is a cross-sectional view taken along line 6—6 of FIG. 2.
Figure 7:
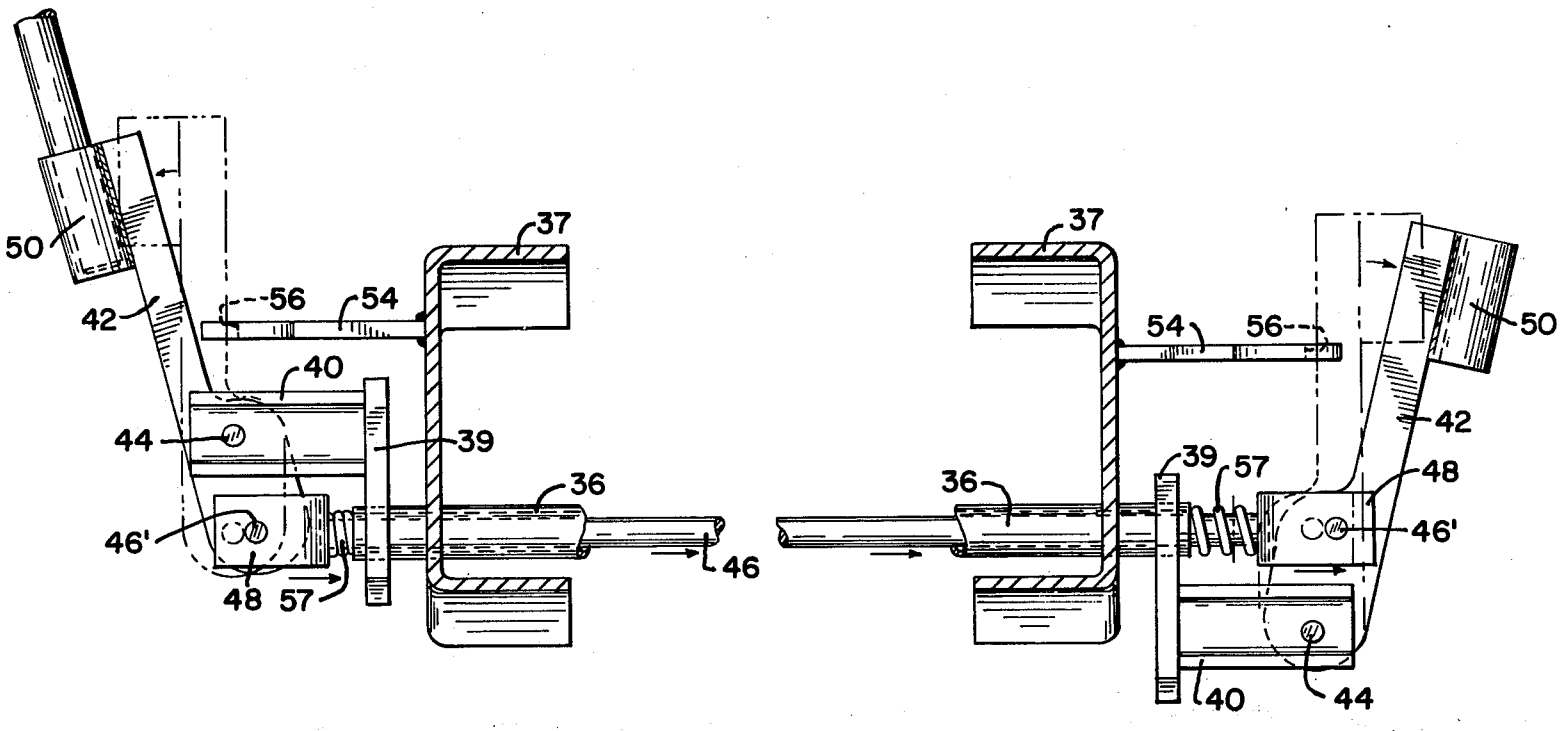
FIG. 7 is a cross-sectional view similar to FIG. 5 disclosing the same arrangement on opposite sides of the hopper car.

As shown in FIGS. 2 and 3, each of the doors 10 is pivotally mounted at its upper edge on the bottom of the hopper car by hinges 14. A horizontal beam 16 extending transverse the car is secured to the bottom edges of a transverse pair of the doors 10 such as to join the pair of doors together. Spaced brackets or bearings 18 are mounted on the beam 16 between the pair of transverse doors and rotatably support a shaft 20. A pair of spaced hook members 22 are fixed on the shaft 20 at the ends of the hook members while the opposite ends of the hook members 22 are formed into hooks 24 for engaging respective locking lugs 26 fixed by brackets 28 to the bottom of a central sill 30 forming a portion of a frame of the hopper car. Also one end of a dog-legged-shaped link 32 is secured on the shaft 20. The other end of the link 32 is pivotally connected between one end of spaced parallel arms 34 mounted on a tubular crank shaft 36 rotatably mounted on supports 37 on opposite sides of the bottom of the hopper (as shown in FIG. 7) and by supports 38, on the sill 30. The crank shaft 36 extends to opposite sides of the car and is attached at its ends to plate members 39, FIG. 5, having brackets 40 thereon pivotally supporting handles 42 at fulcrum points 44 spaced from the axis of rotation of the crank shaft 36. As shown in FIG. 7 plates 39 on opposite sides of the car extend reversely vertically with brackets 40 on one side of the car being above tubular shaft 46 and on the other side being below. Thus pivots 44 and 46' relative to arms 42 are also reversed to permit outward movement of arms 42 as described in the operation below. A rod 46 slidably extending into the tubular shaft 36 is pivotally mounted at its ends, as indicated at 46' on handles 42 by clevis members 48. As best shown in FIGS. 5 and 7 a coil spring 57 on rod 46 is captive between clevis 48 and the end of shaft 36 on opposite sides of the car. The other end of each handle 42 has a bar receiving member 50 secured thereon for receiving an end of a bar (51 shown in phantom in FIG. 3) to provide leverage for moving the handle 42 in rotating the shaft 36.

The length of the link 32 is selected to close the door 10 when the arm 34 is rotated to extend about horizontally away from the door 10 (FIG. 2). The bend in the dog-legged-draped link 32 is designed to allow a substantial arc of movement of the arm 34 at the horizontal position shown in FIG. 3 without interference due to the link 32 engaging the shaft 36 so that throughout such arc the link 32 is mainly pivoted without any longitudinal movement of the link 32; the hook member 22 extends at an angle from the shaft 20 such that the hook 24 engages the leg 26 when the arm 34 is rotated counter clockwise to the horizontal position, and such that the hook 24 disengages the leg 25 when the arm 34 is rotated clockwise from the horizontal position during the first pivotal movement of the link 32 (see FIG. 4). The arm 34 has a length selected to move the link 32 longitudinally when the crank shaft 36 and arm 34 are rotated clockwise sufficiently to pivot the doors 10 to the fully open position (shown in phantom in FIG. 2).

A plate or flange 54, FIGS. 2, 3 and 5, extends from each support 37 and a notch 56 formed in its extending end for receiving and retaining the handle 42 when the handle 42 is rotated to the door closed position and pivoted to an inward position relative to the side of the car.

Figure 4:
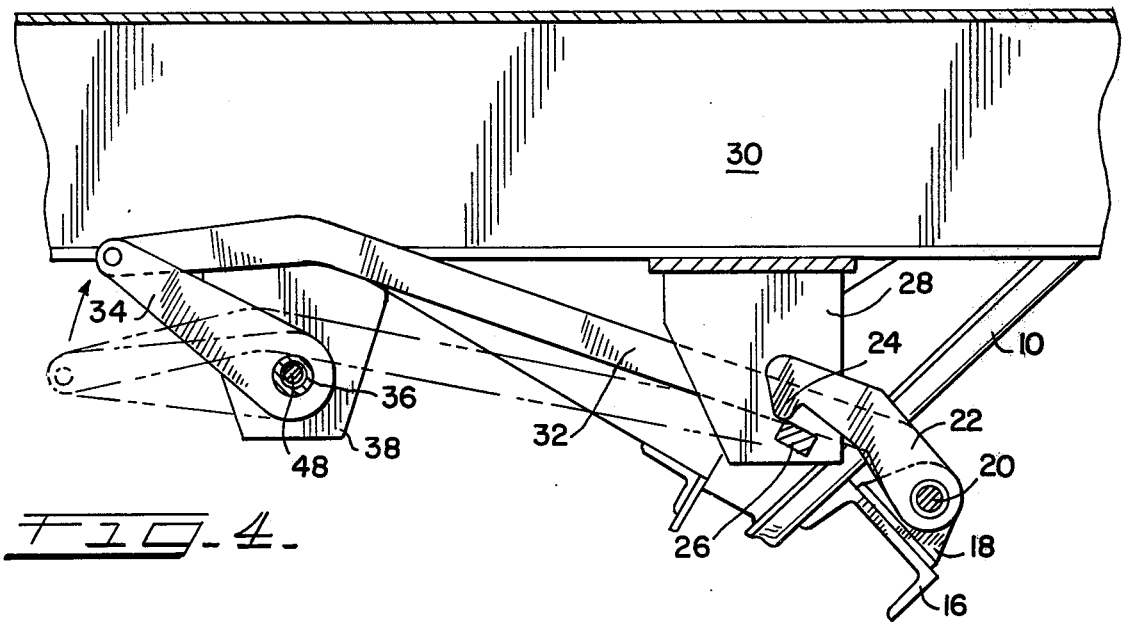
FIG. 4 is a cross-sectional view taken along line 4—4 of FIG. 3.

In operation of the door closing and locking mechanism 12 of FIG. 1, the door 10 is normally held closed when the handles 42 are retained within the notches 56 of the flanges or stops 54 wherein the arms 34 of the crank is in its most horizontal counter clockwise rotated position as shown in FIG. 2. The hooks 24 engage the locking lugs 26 to lock the doors 10 closed. Upon movement of the handle 42 from the notch 56, as shown in phantom in FIG. 3, the handle 42 is rotated clockwise as shown in FIG. 4 and in phantom in FIG. 2. During a first portion of the rotation of the handle 42 the arm 34 pivots upward rotating the link 32 and the shaft 20 clockwise to rotate the hook members 22 clockwise disengaging the hooks 24 from the locking lugs 26. Continued rotation of the crank member 42 and the arm 34 moves the link 32 longitudinally to the right as viewed in FIG. 2 to pivot the covers 10 about the hinges 14 to their fully open positions.

When it is desired to close the doors 10 the handle 42 is rotated back counter clockwise to initially pull the link 34 to the left as shown in FIG. 2 and to close the door 10. Continued counter clockwise rotation of the handle 42 rotates the link 32, shaft 20 and hook member 24 counterclockwise to engage the hook 24 with the locking lug 26 thus locking the door 10 in the closed position. The handle 42 is then pivoted back into the notch 56 of the plate 54 or lock so that the handle 42 is retained in its counter-clockwise rotated position.

As best shown in FIG. 7, when one handle 42 on one side of the car is pulled outwardly from a notch 56, the other handle 42 is also moved outwardly to a disengaged position. One spring 57 is compressed and the other is extended. When one handle by the operator is engaged in one notch the other is similarly engaged and springs 57 biasingly maintain the handles in their respective notches. This movement of the handles is achieved by mounting the plate member 39 to extend downwardly in an opposite direction with respect to the other plate member which extends upwardly from the tubular shaft 36. Also whereas brackets 40 on one side are mounted above shaft 36, brackets 40 on the other side are mounted below shaft 36. This of course provides for the synchronous movement of both arms 42 outwardly and inwardly.

It is noted that the locking and closing of the door 10 is accomplished by one single rotative movement of the handle 42. Thus it is not necessary to have a plurality of operations in closing and locking the door. Further the provision of a handle 42 pivoted on the brackets 44 spaced from the axis of rotation of the crank shaft 36 with the rod 48 securing the end of the lever 42 relative to the axis allows the handle 42 to be pivoted back into a position where it does not extend from the side of the car and at the same time results in less stress on the pivot connection to the crank shaft; thus there is less tendency for breakage of the pivot junction between the handle 42 and the crank shaft 36.

Since many modifications, variations and changes in detail may be made to the presently described embodiment, it is intended that all matter in the foregoing description and shown in the accompanying drawings be interpreted as illustrative and not in a limiting sense.

What is claimed is:

1. A closing and locking arrangement for a pivoted door on a hopper comprising a shaft, bearing means rotatably mounting the shaft on the door spaced from the door pivot, an elongated hook member having one end fixedly secured to the shaft and having a hook formed in the other end of the hook member, a locking lug fixed relative to the hopper for cooperating with the hook on the hook member to secure the door closed, an operating link directly, fixedly secured to the shaft, and crank means including an arm eccentrically pivoted to the other end of the operating link for pivoting the link to release and engage the hook with the locking lug and for pivoting the door between open and closed positions.

2. A closing and locking arrangement for a pivoted hopper door as claimed in claim 1 wherein the crank means includes:

a crank shaft, a crank plate fixed to the crank shaft, a handle bracket means mounted on the crank plate spaced from the axis of rotation of the crank shaft and being pivotally connected with and supporting the handle about a pivot axis transversely oriented relative to the axis of rotation of said crank shaft means for pivotal movement between locked and unlocked positions, said handle adapted to rotate said crank shaft, and stop means fixed relative to said hopper and adapted to engage said handle in the locked position when said door is in the closed position thereby securing the door.

3. A closing and locking arrangement as claimed in claim 2, said stop means being secured on one side of said hopper, a second crank plate fixed to the crank shaft on the other side of said hopper, second bracket means mounted on the second crank plate and spaced from the axis of rotation of the crank shaft, a second handle pivotally supported by said second bracket for pivotal movement between locked and unlocked positions about a pivot axis transversely oriented relative the crank shaft axis of rotation, said handle adapted to rotate said crank shaft, second stop means secured to the other side of said hopper and fixed relative thereto and adapted to engage and retain said second handle in the locked position when said door is in the closed position, rod means pivotally connected to each of said handles whereby movement by an operator of one handle outwardly out of engagement with its respective stop means simultaneously disengages the other handle from its respective stop means.

4. A closing and locking arrangement as is claimed in 3, including biasing means operatively connected with said rod means for urging said handles into engagement with said stop means.

5. A closing and locking arrangement as claimed in claim 4, said first mentioned crank plate projecting vertically upwardly above said crank shaft and said first mentioned bracket means being mounted thereon above said shaft, and said pivotal connection of said first mentioned arm to said first mentioned bracket being disposed intermediate said first mentioned arm.

6. A closing and locking arrangement for a pair of transversely disposed doors pivotally hinged on a horizontal axis for respective bottom discharge openings of hoppers in a hopper car, the arrangement comprising a horizontal beam secured to the doors spaced from the horizontal axis, a hook shaft, bracket means on the beam between the doors rotatably supporting the hook shaft, a pair of locking lugs fixed relative to the hoppers, a pair of elongated hook members having one end fixedly secured to the hook shaft and having hooks formed in their other ends for cooperating with the locking lugs to lock the doors closed, an elongated link fixedly secured at one end to the hook shaft, a crank shaft rotatably supported transverse the hopper car to extend to one side of the hopper car, an arm mounted at one end on the crank shaft and pivotally connected at its other end to the other end of the link, said link and arm having respective lengths such that when the arm is rotated by the crank shaft to extend away from the hook shaft, the doors are closed, and, said hook members extending away from the hook shaft such that during a portion of the rotation of the crank shaft and arm, the link rotates the hook shaft and hook members to engage the hooks with the locking lugs.

7. A closing and locking arrangement as claimed in claim 6 wherein the crank shaft includes a crank plate fixed on one end of the crank shaft at one side of the hopper car, a handle crank bracket means mounted on the crank plate spaced from the axis of rotation of the crank shaft and being pivotally connected with and supporting the handle about a pivot axis transversely oriented relative to the crank shaft axis of rotation for pivotal movement of the handle between locked and unlocked positions, said handle adapted to rotate said crank shaft, stop means fixed relative to said hopper and adapted to engage and retain said handle in the locked position thereby preventing rotation of said crank shaft and securing the doors closed.

8. The invention in accordance with claim 7, including biasing means for urging said handle into engagement with said stop means.

9. A closing and locking arrangement for a pivoted door on a hopper having a discharge opening comprising:

linkage means connected to said door for pivoting said door between a closed position and an open position relative to said discharge opening, crank shaft means connected to said linkage means and rotatable to move said door between closed and open positions, bracket means fixed to said crank shaft means and adapted for rotation therewith, handle means pivotally supported by said bracket means and having a pivot axis radially spaced from and transversely oriented relative to the axis of rotation of said crank shaft means, and adapted to rotate said crank shaft means between open and closed positions, and stop means fixed relative to said hopper and adapted to engage said handle means in locking relation when said handle means are in the closed position thereby securing said door in the closed position.

10. The invention in accordance with claim 9, including biasing means operatively interconnected to said handle means and said crank shaft means for urging said handle means into locking relation with said stop means, whereby movement by an operator of said handle means out of locking relation with said stop means in opposition to said biasing means allows the operator to rotate said crank shaft means and open said hopper door.

11. The invention in accordance with claim 9, said bracket means having plate means affixed to said crank shaft means, and a bracket element affixed to said plate means and spaced from the axis of rotation of said crank shaft means, said bracket element pivotally supporting said handle means.

12. The invention in accordance with claim 9, said hopper door having a locking arrangement including a lock shaft, bearing means rotatably mounting the lock shaft on the door spaced from the door pivot, an elongated hook member having one end secured to the lock shaft and having a hook formed in the other end of the hook member, and a locking lug fixed relative to the hopper for cooperating with the hook on the hook member to secure the door in the closed position, said linkage means being secured to the lock shaft whereby rotation of said crank shaft means pivots the linkage means for releasing and engaging the hook relative to the locking lug attendant to pivoting the door between open and closed positions.

13. The invention in accordance with claim 9, said stop means being secured on one side of said hopper, said bracket means including a first bracket fixed to one end of said crank shaft means and a second bracket fixed to the other end of said crank shaft means, said handle means including a pair of handles each being pivotally supported, respectively, by one of said brackets and having a pivot axis spaced from and transversely oriented relative to the axis of rotation of said crank shaft means, each handle adapted to rotate said shaft between open and closed positions, rod means pivotally attached to each of said handles and being displaced longitudinally attendant to either of said handles pivoting relative to its respective bracket, said stop means including a pair of stops on the hopper and each being adapted to engage a respective handle in locking relation when said handles are in closed position, whereby movement of either handle from engagement with its respective stop results in simultaneous disengagement of the other handle from its respective stop, allowing said crank shaft means to be rotated by either of said handles.

14. The invention in accordance with claim 13, including biasing means operatively connected with said handle means for urging each handle into locking relation with its respective stop.

15. The invention in accordance with claim 9, said crank shaft means including a tubular shaft on which said bracket means are fixed and a rod extending through said shaft along the axis of rotation thereof, and one end of said rod being pivotally connected to said handle means whereby pivotal movement of said handle relative to said bracket means displaces said rod longtudinally within said tubular shaft.

16. The invention in accordance with claim 15, including biasing means operatively connected between said rod and said tubular shaft for urging said handle means into locking relation with said stop means.

17. The invention in accordance with claim 16, said biasing means comprising spring means.

* * * * *